US011867406B2

(12) United States Patent
Li et al.

(10) Patent No.: US 11,867,406 B2
(45) Date of Patent: Jan. 9, 2024

(54) RANGE HOOD

(71) Applicant: FOSHAN SHUNDE MIDEA WASHING APPLIANCES MANUFACTURING CO., LTD., Foshan (CN)

(72) Inventors: Jiayang Li, Foshan (CN); Jianyu Wang, Foshan (CN); Xiaokang Peng, Foshan (CN); Benfeng Li, Foshan (CN)

( * ) Notice: Subject to any disclaimer, the term of this patent is extended or adjusted under 35 U.S.C. 154(b) by 0 days.

(21) Appl. No.: 17/771,011

(22) PCT Filed: Dec. 11, 2019

(86) PCT No.: PCT/CN2019/124647

§ 371 (c)(1),
(2) Date: Apr. 22, 2022

(87) PCT Pub. No.: WO2021/093070

PCT Pub. Date: May 20, 2021

(65) Prior Publication Data

US 2022/0364736 A1 Nov. 17, 2022

(30) Foreign Application Priority Data

Nov. 11, 2019 (CN) ..... 201911099177.0

(51) Int. Cl.
*F24C 15/00* (2006.01)
*F24C 15/20* (2006.01)

(52) U.S. Cl.
CPC ..... *F24C 15/20* (2013.01)

(58) Field of Classification Search
CPC ..... F24C 15/20
USPC ..... 126/299 R, 299 D
See application file for complete search history.

(56) References Cited

FOREIGN PATENT DOCUMENTS

| | | | |
|---|---|---|---|
| CN | 101349445 A | | 1/2009 |
| CN | 103486636 A | | 1/2014 |
| CN | 203421765 U | | 2/2014 |
| CN | 104180412 A | * | 12/2014 |
| CN | 204187699 U | | 3/2015 |
| CN | 104180412 B | | 9/2016 |
| CN | 106322474 A | | 1/2017 |
| CN | 206018758 U | | 3/2017 |

(Continued)

OTHER PUBLICATIONS

The extended European search report received in the corresponding European application 19952465.3, dated Oct. 10, 2022.

(Continued)

*Primary Examiner* — Ko-Wei Lin
(74) *Attorney, Agent, or Firm* — KILPATRICK TOWNSEND & STOCKTON, LLP

(57) ABSTRACT

Disclosed is a range hood, including: a case provided with a smoke inlet; and a fan provided inside the case. An air inlet area is formed between an air inlet of the fan and a side wall of the case, the air inlet area is provided with a spacer, and the spacer is configured to divide the air inlet area into at least two air inlet sub-areas. The air inlet sub-areas are located at different positions of the air inlet area. The airflow entering the case from the smoke inlet flows to the air inlet of the fan, and the airflow flows to the sub-air inlet area in different directions. The space blocks airflows in different directions, to prevent turbulence at the intersection of airflows in different directions.

18 Claims, 10 Drawing Sheets

(56) References Cited

FOREIGN PATENT DOCUMENTS

| | | | |
|---|---|---|---|
| CN | 207378915 | U | 5/2018 |
| CN | 207515014 | U | 6/2018 |
| CN | 208139359 | U | 11/2018 |
| CN | 110274273 | A | 9/2019 |
| CN | 110701654 | A | 1/2020 |
| JP | H1128159 | A | 2/1999 |
| JP | 2006304882 | A | 11/2006 |
| WO | 2015029403 | A1 | 3/2015 |

OTHER PUBLICATIONS

First OA mailed May 25, 2020 of CN Application No. 201911099111.
0.
ISR of PCT Application No. PCT/CN2019/124647.

* cited by examiner

RANGE HOOD

CROSS-REFERENCES TO RELATED APPLICATIONS

The present disclosure is a national phase application of International Application No. PCT/CN2019/124647, filed on Dec. 11, 2019, which claims priority to Chinese Patent Application No. 201911099177.0, filed on Nov. 11, 2019, the entireties of which are herein incorporated by reference.

FILED

The present disclosure relates to the field of kitchen appliances, in particular to a range hood and an integrated stove.

BACKGROUND

During the operation of the exemplary side-suction range hood, since smoke moves along an inner wall of a case from different angles to an air inlet, the intersection of smoke in different directions is prone to produce airflow turbulence, which increases the air resistance at the air inlet of the fan and affects the operation efficiency of the range hood.

SUMMARY

The main purpose of the present disclosure is to provide a range hood and an integrated stove, which aims to improve the problem that the operation efficiency of the range hood is reduced due to turbulence at the air inlet of the exemplary range hood.

Embodiments of the present disclosure provide a range hood, including:

a case provided with a smoke inlet; and a fan provided inside the case,

In one embodiment, an air inlet area is formed between an air inlet of the fan and a side wall of the case, the air inlet area is provided with a spacer, and the spacer is configured to divide the air inlet area into at least two air inlet sub-areas.

The spacer separates the air inlet area, and each of the air inlet sub-areas takes in the air, which enables the airflow to enter the fan from different air inlet sub-areas in a dispersed manner, to prevent the problem of turbulence in the air inlet area caused by different airflow directions.

In an embodiment, the spacer is configured to divide the air inlet area into a main air inlet area close to the smoke inlet and an auxiliary air inlet area away from the smoke inlet, the main air inlet area is in communication with the smoke inlet; and a first air passage is formed between an outer wall of a volute of the fan and an inner wall of the case, and the auxiliary air inlet area is in communication with the smoke inlet through the first air passage.

The main air inlet area is close to the flue. Most of the smoke enters the fan through the main air intake area, and enters the auxiliary air intake area along the gap between the case and the volute. Under the blocking of the spacer, the smoke in the auxiliary air intake area and the smoke in the main air intake area will not occur turbulence.

In an embodiment, a second air passage is formed between the outer wall of the volute of the fan and the inner wall of the case; and the first air passage and the second air passage are respectively provided on two sides of the fan, and one end of the second air passage away from the smoke inlet is in communication with the auxiliary air inlet area.

The first air passage and the second air passage are respectively provided on both sides of the volute, and the airflow on both sides of the fan can enter the auxiliary air inlet area along the first air passage and the second air passage respectively. Further, the airflow between the outer wall of the volute and the inner wall of the case can be divided, to prevent the problem of excessive air resistance in the space between the volute and the case.

In an embodiment, an area of the main air inlet area is equal to an area of the auxiliary air inlet area.

The spacer divides the air inlet area into two parts. One part is directly in communication with the smoke inlet, and the other part is configured for the input of smoke in the gap between the volute and the inner wall of the case, to realize the synchronous smoke input of the main air inlet area and the auxiliary air inlet area.

In an embodiment, a distance that the spacer is offset from a rotation center of the fan to a direction of the smoke inlet is not more than 0.2 times a diameter of the air inlet of the fan; or a distance that the spacer is offset from the rotation center of the fan to the direction away from the smoke inlet is not more than 0.1 times the diameter of the air inlet of the fan.

When the amount of smoke in the main air inlet area and the auxiliary air inlet area is different, the size of the main air inlet area and the auxiliary air inlet area can be adjusted by adjusting the offset position of the spacer, and the area of each air inlet area can be adjusted according to the flow rate of the smoke. Since the smoke flow in the main air inlet area on the side close to the smoke inlet is relatively large, the noise generated by it is also relatively large. The spacer is offset by a larger distance along the direction of the smoke inlet, and the smoke in the main air inlet area can be quickly guided into the fan, to shortening the moving distance of a large amount of smoke and reducing the noise in the air inlet area.

In an embodiment, the air inlet area is provided with two spacers;

a distance between the spacer close to the smoke inlet and a rotation center of the fan is not more than 0.2 times a diameter of the air inlet of the fan; and/or a distance between the spacer away from the smoke inlet and the rotation center of the fan is not more than 0.1 times the diameter of the air inlet of the fan.

When the fan rotates, the amount of smoke at different positions in the air inlet area is different. By using two of the spacers, the spacers can be arranged at different positions of the air inlet area, and the positions of the spacers can be adjusted according to the amount of smoke at different positions of the air inlet area.

In an embodiment, the air inlet area is provided with two spacers, the two spacers are respectively provided in the main air inlet area and the auxiliary air inlet area;

a distance between the spacer in the main air inlet area and a rotation center of the fan is not more than 0.2 times the diameter of the air inlet of the fan; and a distance between the spacer in the auxiliary air inlet area and the rotation center of the fan is not more than 0.1 times the diameter of the air inlet of the fan.

Since the main air inlet area is closer to the smoke inlet, the amount of smoke in the main air inlet area is larger, and the distance between the spacer located in the main air inlet area and the smoke inlet is closer, a large amount of smoke can be quickly guided into the fan under the action of the spacer, avoiding the noise caused by the long-distance flow of smoke. The deviating range of the spacer located in the auxiliary air inlet area is relatively smaller, and the smoke in the auxiliary air inlet area can be concentrated in the auxiliary air inlet area. Since the side of the auxiliary air inlet area is far away from the smoke inlet, the smoke flow on the side of the auxiliary air inlet area is relatively small. Blocking the airflow in the auxiliary air intake area by the spacer causes turbulence in the main air intake area.

In an embodiment, the spacer is provided on an inner wall of the case.

The spacer is provided on the inner wall of the case, and there is no gap between the spacer and the inner wall of the case, to avoid the problem of turbulence caused by airflow flowing out through the gap between the spacer and the case.

In an embodiment, a distance between one end of the spacer close to the air inlet and the inner wall of the case is not more than 0.8 times a distance between the inner wall of the case and the air inlet.

The spacer partially isolates the main air inlet area and the auxiliary air inlet area. When the airflow flows along the case, the airflow can be guided to the fan under the action of the spacer without affecting the normal operation of the fan. During the movement of the airflow, no reverse flow will be generated under the action of the spacer, which further avoids turbulence.

In an embodiment, the spacer includes a first guide plate and a second guide plate, an angle is formed between the first guide plate and the second guide plate, and the angle between the first guide plate and the second guide plate gradually increases from the air inlet to the inner wall of the case.

The first guide plate and the second guide plate form an inclined structure, when the airflow flows along the first guide plate and the second guide plate, it can be gradually turned to the fan without a sharp angle change, to prevent turbulence at the position of the spacer.

In an embodiment, the angle between the first spacer and the second spacer is at least 60° and not more than 120°.

In an embodiment, a first guide surface is formed at a side of the first guide plate away from the inner wall of the case, and a second guide surface is formed at a side of the second guide plate away from the case;

an angle between the first guide surface and the inner wall of the case is not more than that between the second guide surface and the inner wall of the case; and a difference between the angle between the second guide surface and the inner wall of the case minus the angle between the first guide surface and the inner wall of the case is not more than 30°.

Since the air volumes of the main air inlet area and the auxiliary air inlet area are different, the angle on one side of the main air inlet area is smaller than that on the side of the auxiliary air inlet area, and the side of the main air inlet area can play a better flow guiding effect, and a large amount of air flow can be quickly guided to the direction of the blades of the impeller, to improve the utilization efficiency of the impeller.

In an embodiment, the first guide surface and/or the second guide surface are arc surfaces.

By adopting the arc surface, the effect of smooth flow can be achieved, and turbulent flow can be prevented from occurring in the first guide surface and/or the second guide surface.

In an embodiment, the smoke inlet is located under the case, and the spacer divides the air inlet area into a lower main air inlet area and an upper auxiliary air inlet area.

In an embodiment, a first air passage and a second air passage are formed between outer walls of the volute on both sides of the fan and the inner wall of the case;

one end of the first air passage and one end of the second air passage away from the smoke inlet are respectively in communication with portions of the air inlet area away from the smoke inlet; and the spacer is configured to divide the air inlet area into a first air inlet area on a side close to the first air passage and a second air inlet area on a side close to the second air passage.

In an embodiment, the air inlet is divided, by a partition surface along a radial direction thereof, into a main air inlet area and an auxiliary air inlet area;

the main air inlet area is located on a side of the air inlet close to the smoke inlet, and the auxiliary air inlet area is located on a side of the air inlet away from the smoke inlet; and one end of the case away from the smoke inlet is provided with a bottom plate, one end of the spacer away from the smoke inlet is connected to the bottom plate, and one end of the spacer away from the bottom plate is extended into the auxiliary air inlet area.

In an embodiment, one end of the spacer away from the bottom plate is flush with a rotation center of the fan; or one end of the spacer away from the bottom plate is located in the auxiliary air inlet area.

In an embodiment, an area of the first air inlet area is larger than an area of the second air inlet area.

In an embodiment, the smoke inlet is located above the case, and a width of one end of the case away from the smoke inlet is gradually decreased, and the end of the case away from the smoke inlet has a V-shaped structure.

On the basis of the above range hood, the present disclosure provides an integrated stove, including the range hood described above.

In the embodiments of the present disclosure, the spacer separates the air inlet area of the fan to form air inlet sub-areas, the airflow entering the multiple air inlet sub-areas can be blocked by the spacer, and there will be no turbulence between the airflows, to avoid the problem of air resistance at the air inlet of the fan caused by the turbulence.

BRIEF DESCRIPTION OF THE DRAWINGS

In order to more clearly illustrate the embodiments of the present disclosure, drawings used in the embodiments will be briefly described below. The drawings in the following description are only some embodiments of the present disclosure.

DESCRIPTION OF REFERENCE SIGNS

Figure 1:
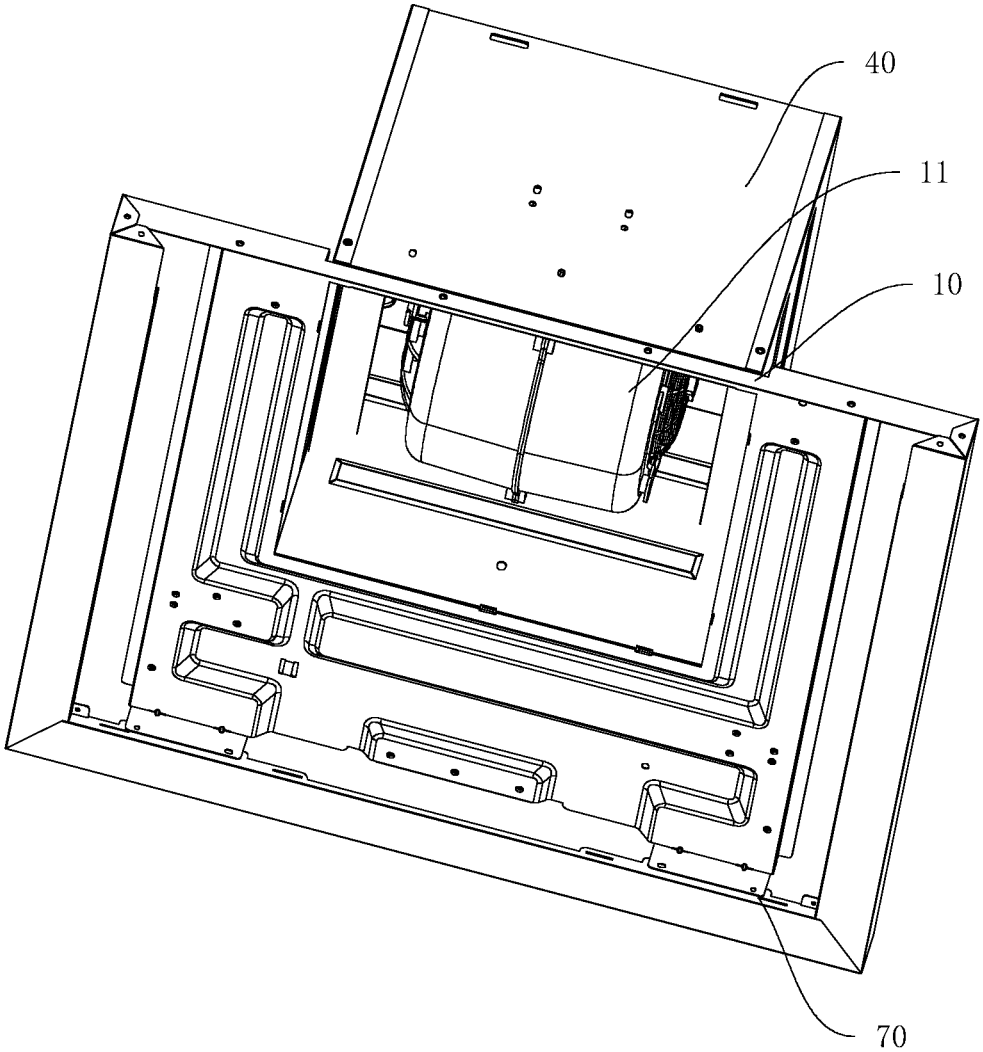
FIG. 1 is a schematic structural view of a range hood according to a first embodiment of the present disclosure.

| Reference sign | Name |
|---|---|
| 10 | range hood |
| 11 | fan |
| 12 | volute |
| 122 | air inlet |
| 13 | impeller |
| 14 | air guide ring |
| 30 | motor |
| 40 | case |
| 41 | smoke inlet |
| 50 | air inlet area |
| 51 | main air inlet area |
| 52 | auxiliary air inlet area |
| 53 | first air inlet area |
| 54 | second air inlet area |
| 55 | first air passage |
| 56 | second air passage |
| 60 | spacer |
| 61 | first guide plate |
| 62 | second guide plate |
| 63 | support portion |
| 64 | first guide surface |
| 65 | second guide surface |
| 66 | bottom plate |
| 70 | fume collecting hood |
| 80 | integrated stove |
| 81 | range hood system |
| 82 | additional assembly |
| 83 | handpiece |
| 84 | handpiece inlet |

Embodiments of the present disclosure are further described with reference to the accompanying drawings.

DETAILED DESCRIPTION OF THE DISCLOSURE

The embodiments of the present disclosure will be clearly and completely described below with reference to the accompanying drawings in the embodiments of the present disclosure. The embodiments to be described are only some rather than all of the embodiments of the present disclosure.

It should be noted that if there is a directional indication (such as up, down, left, right, front, rear . . . ) in the embodiments of the present disclosure, the directional indication is only used to explain the relative positional relationship, movement, etc. of the components in a posture (as shown in the drawings). If the specific posture changes, the directional indication will change accordingly.

In addition, the descriptions associated with, e.g., "first" and "second," in the present disclosure are merely for descriptive purposes, and cannot be understood as indicating or suggesting relative importance or impliedly indicating the number of the indicated embodiments. Therefore, the feature associated with "first" or "second" can expressly or impliedly include at least one such feature.

Figure 2:
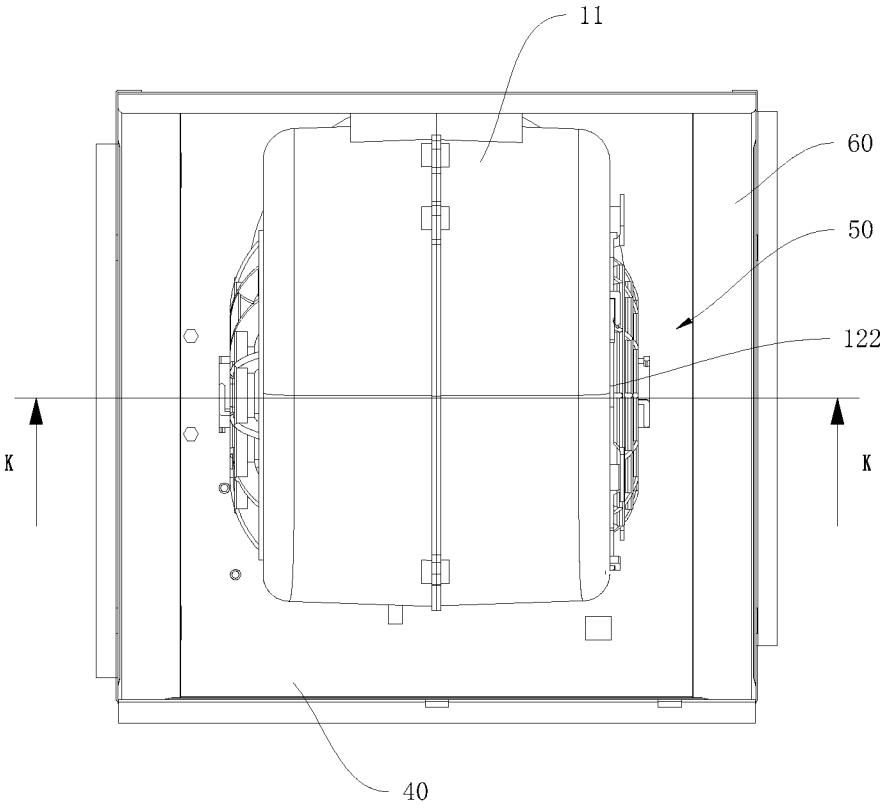
FIG. 2 is a bottom view of a case in FIG. 1.

As shown in FIG. 1 and FIG. 2, FIG. 1 is a schematic structural view of a range hood according to a first embodiment of the present disclosure, and FIG. 2 is a bottom view of the case in FIG. 1. The first embodiment of the present disclosure provides a range hood, including: a case 40 provided with a smoke inlet 41; and a fan 11 inside the case 40, and an air inlet area 50 is formed between an air inlet 122 of the fan 11 and a side wall of the case 40, the air inlet area 50 is provided with a spacer, and the spacer is configured to divide the air inlet area into at least two air inlet sub-areas.

The air inlet sub-areas are located at different positions of the air inlet area 50. When the airflow entering the case 40 from the smoke inlet 41 flows to the air inlet 122 of the fan 11, the airflow flows to the air inlet sub-areas in different directions, and the spacers 60 block the airflow in different directions, to prevent turbulence at the intersection of airflows in different directions.

The rotation center of the fan 11 is taken as the center, two diameters of the air inlet 122 are taken as the X and Y axes, the air inlet area 50 is divided into four quadrants from the first to the fourth as four air inlet sub-areas, four spacers 60 can be provided, and the air inlet area 50 forms four air inlet sub-areas. When the fan 11 rotates, the air flow of each sub-air inlet area is different, and the flow direction of the air is also different. The spacer 60 can guide the airflow, and the spacer 60 can prevent turbulence at the intersection of airflows in different air inlet sub-areas, to reduce the air resistance at the position of the air inlet 122.

The spacer 60 separates the air inlet area 50 to form two air inlet sub-areas. One of the air inlet sub-areas is close to the smoke inlet 41, and the other is relatively far away from the smoke inlet 41, and the airflow entering from the smoke inlet 41 enters the fan 11 from the two air inlet sub-areas 50 under the action of the spacer 60. The installation position of the spacer 60 can also be adjusted according to the airflow distribution at the air inlet 122 when the fan 11 is running, to prevent the airflow turbulence in different directions, it can guide the airflow entering the fan 11 to improve the operation efficiency of the fan 11.

The range hood 10 can also include other structural components, such as a fume collecting hood 70, an air intake ring, or the like, which can be referred to as exemplary technologies, and will not be repeated herein.

Figure 3:
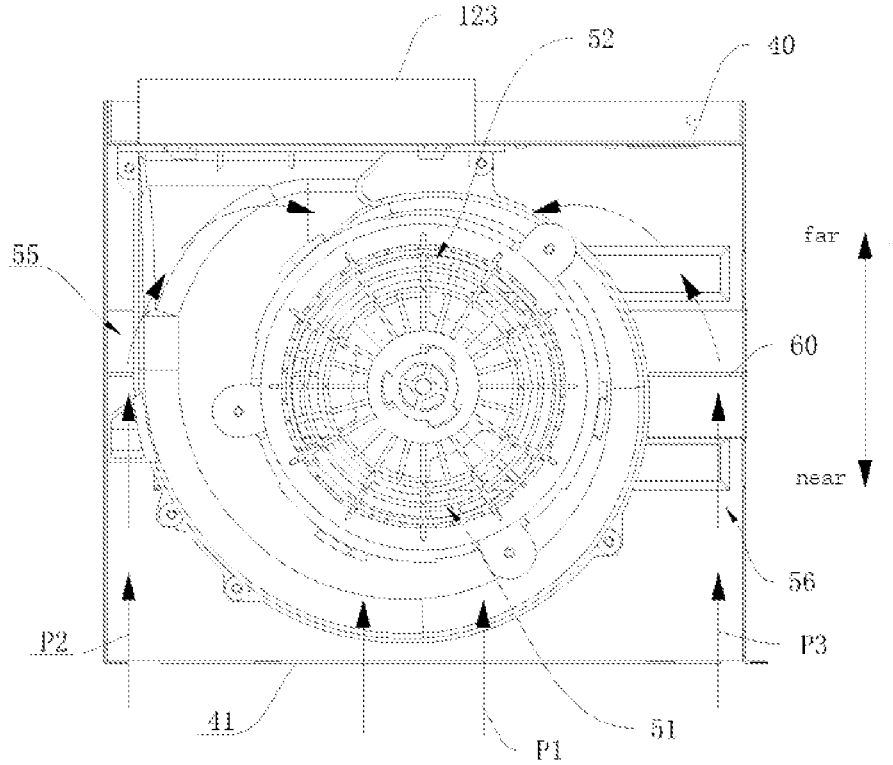
FIG. 3 is a schematic view of the airflow distribution in the air inlet area inside the case according to a second embodiment of the present disclosure.
Figure 4:
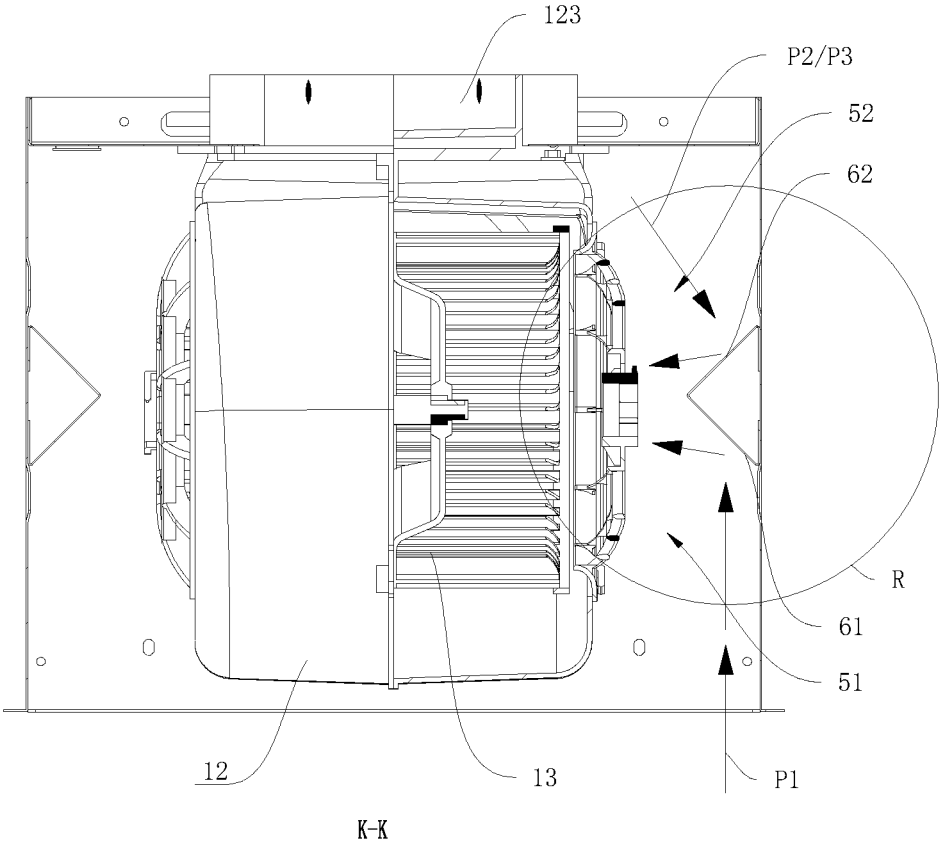
FIG. 4 is a sectional view in FIG. 2 along the line K-K.

As shown in FIG. 3 and FIG. 4, FIG. 3 is a schematic view of the airflow distribution in the air inlet area inside the case according to a second embodiment of the present disclosure, and FIG. 4 is a sectional view in FIG. 2 along the line K-K. In combination with FIG. 1 and FIG. 2, in a second embodiment of the present disclosure, based on the first embodiment, the spacer 60 is configured to divide the air inlet area 50 into a main air inlet area 51 close to the smoke inlet 41 and an auxiliary air inlet area 52 away from the smoke inlet 41, the main air inlet area 51 is in communication with the smoke inlet 41; and a first air passage 55 is formed between an outer wall of a volute 12 of the fan 11 and an inner wall of the case 40, and the auxiliary air inlet area 52 is in communication with the smoke inlet 41 through the first air passage 55.

The main air inlet area 51 is close to the smoke inlet 41. Part of the smoke flows toward the main air inlet area 51 along the direction of P1 as shown in FIG. 3. Since there is usually a gap between the outer wall of the volute 12 of the fan 11 and the inner wall of the case 40, the gap between the outer wall of the volute 12 and the inner wall of the case 40 forms the first air passage 55. Part of the smoke enters the auxiliary air inlet area 52 from the first air passage 55 along the direction of P2 as shown in FIG. 3. Due to the blocking of the case 40 and the negative pressure of the fan 11, the smoke entering the auxiliary air inlet area 52 along the direction of P2 will flow to the air inlet 122 in the opposite direction to the direction of P1. When the airflows of the main air inlet area 51 and the auxiliary air inlet area 52 meet, turbulence will be generated outside the air inlet 122, resulting in increased air resistance at the air inlet 122 and affecting the operation efficiency of the fan 11.

In this embodiment, the spacer 60 is provided at the air inlet 122. The spacer 60 is blocked at the intersection of the air flow of the main air inlet area 51 and the auxiliary air inlet area 52, to prevent the intersection of the two airflows, to avoid turbulence at the intersection of the two airflows.

Under the action of the spacer 60, two airflows can flow along the spacer 60 toward the air inlet 122 of the fan 11, and the spacer 60 can be used to guide the airflow to prevent turbulence at the air inlet 122. Through the diversion effect of the spacer 60, the smoke can flow to the air inlet 122 in a concentrated manner, to help to increase the air intake volume of the fan 11 and improving the operation efficiency of the fan 11.

When the airflow flows along the inner wall of the case 40, and the distance of the airflow is long, the airflow tends to generate noise. When the fan 11 is running, the airflow volume along the direction of P1 in FIG. 3 is usually large. When the airflow continues to flow into the case 40, it is easy to cause noise. By arranging the spacer 60, the airflow along the direction of P1 as shown in FIG. 3 can be blocked from continuing to flow into the case 40. Thus, the moving distance of most of the airflow is shortened, the noise generated when the airflow moves is reduced, and the overall noise reduction of the range hood 10 is facilitated.

The smoke inlet 41 can be set at any position of the case 40. The spacer 60 separates the air inlet area 50 into a main air inlet area 51 close to the smoke inlet 41 and a secondary air inlet area 52 away from the smoke inlet 41. The range hood 10 in FIG. 2, FIG. 3 and FIG. 4 is taken as an example, the smoke inlet 41 is disposed below the case 40, and the spacer 60 separates the air inlet area 50 to form a lower main air inlet area 51 and an upper auxiliary air inlet area 52. The smoke inlet 41 can also be set at other positions, for example, at the upper end of the case 40, at this time, the main air inlet area 51 is located at the upper part, and the auxiliary air inlet area 52 is located at the lower part.

As shown in FIG. 3, in another possible embodiment of the present disclosure, on the basis of the second embodiment, a second air passage 56 is formed between the outer wall of the volute 12 of the fan 11 and the inner wall of the case 40; and the first air passage 55 and the second air passage 56 are respectively provided on two sides of the fan 11, and one end of the second air passage 56 away from the smoke inlet 41 is in communication with the auxiliary air inlet area 52. There are gaps between both sides of the housing of the fan 11 and the inner wall of the case 40, the first air passage 55 and the second air passage 56 are formed between the two sides of the outer wall of the housing of the fan 11 and the inner wall of the case 40, respectively. When the smoke enters the case 40 from the smoke inlet 41, part of the smoke enters the main air intake area 51 along the direction of P1 as shown in FIG. 3, the airflow located on the side of the volute 12 facing the smoke inlet 41 flows along the outer wall of the volute 12 to the gap between the volute 12 and the inner wall of the case 40. Since there are gaps between the outer walls on both sides of the volute 12 and the inner wall of the case 40, part of the smoke flows along the first air passage 55, that is, the direction of P2 as shown in FIG. 3 flows toward the auxiliary air inlet area 52, and part of the smoke flows along the second air passage 56, that is, the direction of P3 as shown in FIG. 3 flows toward the auxiliary air inlet area 52 to realize the input of smoke.

When the fan 11 is running, the intake air volume in different areas of the fan 11 is different, the air intake volume of the first air passage 55 and the second air passage 56 is positively related to the distance between the outer wall of the volute 12 and the case 40. The first air passage 55 and the second air passage 56 divide the airflow flowing along the outer wall of the volute 12, which can prevent the air flow from turbulent flow between the outer wall of the volute 12 and the inner wall of the case 40 and helps to increase the air intake volume of the fan 11.

The direction of the airflow entering the auxiliary air inlet area 52 along the first air passage 55 and the second air passage 56 is opposite to that entering the main air inlet area 51. The spacer 60 prevents the airflow in the direction of P1 and the direction of P2 or P3 from intersecting with each other as shown in FIG. 4, to avoid air resistance caused by turbulence at the intersection of airflows in different directions.

Since the air flow is guided to the air inlet 122 under the blocking of the spacer 60, the flow distance of the air flow in the direction of P1 and the direction of P2 or P3 in the air inlet area 50 is shortened as shown in FIG. 4. Further, the noise of the airflow in the air inlet area 50 can be reduced, and the effect of reducing the noise of the fan 11 can be achieved.

In order to facilitate installation, in this embodiment, the area of the main air inlet area 51 is equal to the area of the auxiliary air inlet area 52, the spacer 60 divides the air inlet area 50 into two equal parts, to facilitate the positioning and installation of the spacer 60.

Figure 5:
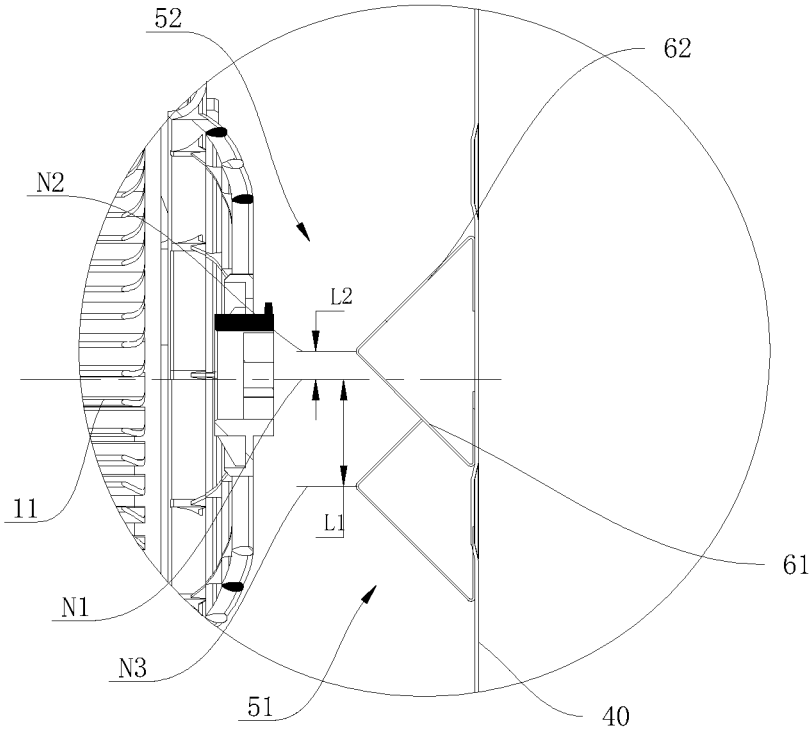
FIG. 5 is a partial enlarged view of the air inlet area when the spacer is offset according to a third embodiment of the present disclosure.

As shown in FIG. 5, FIG. 5 is a partial enlarged view of the air inlet area when the spacer is offset according to a third embodiment of the present disclosure. In the third embodiment of the present disclosure, on the basis of the first embodiment and the second embodiment, a diameter of the air inlet 122 of the fan 11 is $\varphi$, a distance that the spacer 60 is offset from the rotation center of the fan 11 to the direction of the smoke inlet 41 is L1. L1 does not exceed $0.2\varphi$, and the area of the main air inlet area 51 is smaller than the area of the auxiliary air inlet area 52.

N1 is an extension line of the rotation center of the fan 11, and N3 is the position where the spacer 60 is offset from the rotation center to the direction close to the smoke inlet 41.

Since the main air inlet area 51 is close to the smoke inlet 41, the smoke flow of the main air inlet area 51 is relatively large, when a large amount of smoke flows, the longer the flow distance, the greater the noise generated. Therefore, the spacer 60 is offset along the direction of the smoke inlet 41 to shorten the movement distance of the smoke entering the main air inlet area 51, and the smoke can quickly flow toward the air inlet 122 under the action of the spacer 60, to reduce the noise generated by the smoke in the main air intake area 51.

As shown in FIG. 5, in another possible embodiment of the present disclosure, on the basis of the first and second embodiments, the distance that the spacer 60 is offset from the rotation center of the fan 11 to the direction away from the smoke inlet 41 is L2, L2 does not exceed 0.1φ, and the area of the main air inlet area 51 is larger than the area of the auxiliary air inlet area 52.

N1 is the extension line of the rotation center of the fan 11, and N2 is the position where the spacer 60 is offset from the rotation center to the direction away from the smoke inlet 41.

Since the smoke flow in the main air inlet area 51 is relatively large, the spacer 60 is offset in a direction away from the smoke inlet 41, and the area of the main air inlet area 51 is increased, to avoid the problem that a large amount of smoke accumulates in the main air inlet area 51 and causes the operation efficiency of the fan 11 to decrease.

Since the smoke flow in the auxiliary air inlet area 52 is relatively small, the spacer 60 is offset in a direction away from the smoke inlet 41, the smoke entering the auxiliary air inlet area 52 can flow to the air inlet 122 of the fan 11 in a concentrated manner under the blocking of the spacer 60, to have the effect of diversion, the airflow can be concentrated to flow along the direction of the impeller of the fan 11, to improve the utilization rate of the fan 11.

As shown in FIG. 5, when installing the spacer 60, the number of the spacers 60 can be two. When two spacers 60 are used, at least one of the spacers 60 is offset from the rotation center of the fan 11 toward or away from the smoke inlet 41.

In yet another possible embodiment of the present disclosure, on the basis of the first and second embodiments, the diameter of the air inlet 122 of the fan 11 is φ; the distance between the spacer 60 on the side close to the smoke inlet 41 and the rotation center of the fan 11 is L1, and L1 does not exceed 0.2φ. The other spacer 60 is located at the rotation center of the fan 11, the spacer 60 on the side close to the smoke inlet 41 is located in the main air inlet area 51 to block the airflow along the direction of P1 as shown in FIG. 3.

N1 is the extension line of the rotation center of the fan 11, and N3 is the position where the spacer 60 is offset from the rotation center to the direction close to the smoke inlet 41.

The offset distance of the spacer 60 is less than or equal to 20% of the diameter of the air inlet 122, and the range of the main air inlet area 51 can be used for the entry of smoke, and at the same time, the problem of blocking the smoke caused by the too small area of the main air inlet area 51 can be prevented.

Figure 6:
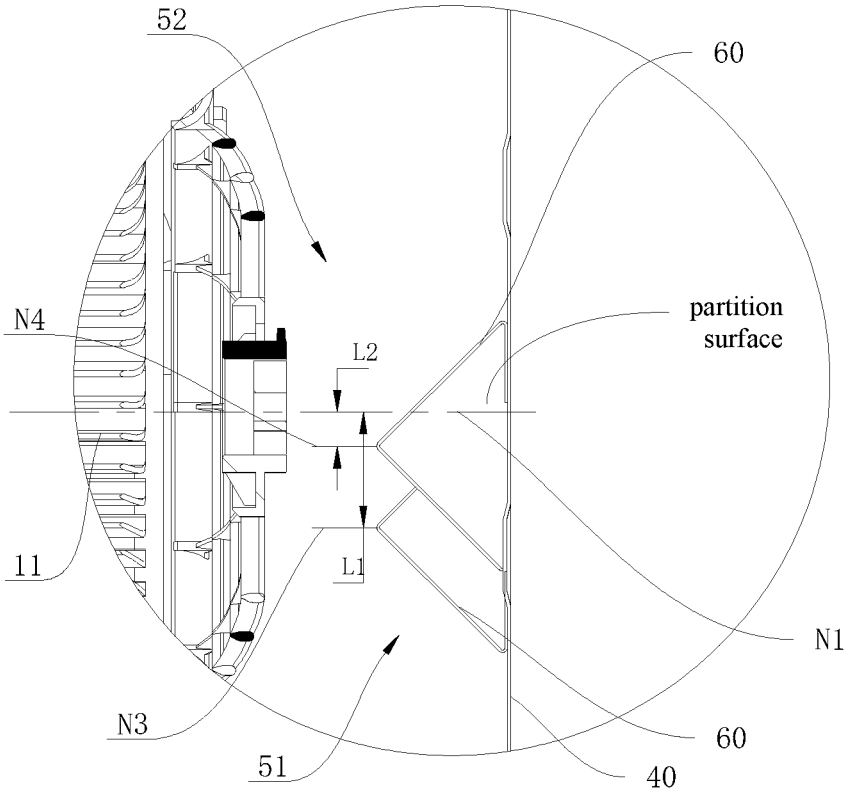
FIG. 6 is a partial enlarged view of the air inlet area when the spacer is located in the main air inlet area according to a fourth embodiment of the present disclosure.

As shown in FIG. 6, FIG. 6 is a partial enlarged view of the air inlet area when the spacer is located in the main air inlet area according to a fourth embodiment of the present disclosure. In the fourth embodiment of the present disclosure, on the basis of the first embodiment and the second embodiment, the diameter of the air inlet 122 of the fan 11 is φ; The distance between the spacer 60 on the side close to the smoke inlet 41 and the rotation center of the fan 11 is L1, and L1 does not exceed 0.2φ. The other spacer 60 is offset by a distance L2 from the rotation center of the fan 11 to the direction of the smoke inlet 41, and L2 does not exceed 0.1φ. The spacer 60 on the side close to the smoke inlet 41 is located in the main air inlet area 51 for blocking the airflow along the direction of P1 as shown in FIG. 3. The two spacers 60 are both located in the main air inlet area 51, and the two spacers 60 are respectively used to block airflow at different positions in the main air inlet area 51.

N1 is the extension line of the rotation center of the fan 11, N3 is the position where one of the spacers 60 is offset from the rotation center to the direction close to the smoke inlet 41, N4 is another position where the spacer 60 is offset from the rotation center to the direction close to the smoke inlet 41.

When the fan 11 is running, the air volume at different positions of the air inlet 122 is different, the two spacers 60 are respectively used for air flow in different areas in the main air inlet area 51, the spacer 60 can be provided according to different air volume positions in the air inlet area 50, to enhance the flow guiding efficiency of the spacer 60 and improve the operation efficiency of the fan 11.

In another possible embodiment of the present disclosure, on the basis of the fourth embodiment, one spacer 60 of the two spacers 60 is located at the rotation center of the fan 11, the distance between the spacer 60 on the side away from the smoke inlet 41 and the rotation center of the fan 11 is L2, and L2 does not exceed 0.1φ. The area of the main air inlet area 51 accounts for half of the area of the air inlet area 50, and the area of the auxiliary air inlet area 52 is reduced.

Since the auxiliary air inlet area 52 is far from the smoke inlet 41, the spacer 60 is offset in a direction away from the smoke inlet 41, and the area of the auxiliary air inlet area 52 is reduced, to improve the operation efficiency of the fan 11 in the auxiliary air inlet area 52.

As shown in FIG. 2 and FIG. 4, in order to facilitate the installation of the spacer 60, on the basis of the first and second embodiments, the spacer 60 is provided on the inner wall of the case 40, and there is no gap between the spacer 60 and the inner wall of the case 40, a support portion 63 can be provided on the side of the spacer 60 close to the inner wall of the case 40 to be fixed on the case 40.

When the airflow enters the case 40, the airflow will flow along the inner wall of the case 40, and the spacer 60 is installed on the inner wall of the case 40, the airflow can only flow along the direction of the air inlet 122 along the spacer 60, to avoid turbulence at the intersection of the airflows of the main air inlet area 51 and the auxiliary air inlet area 52.

Figure 7:
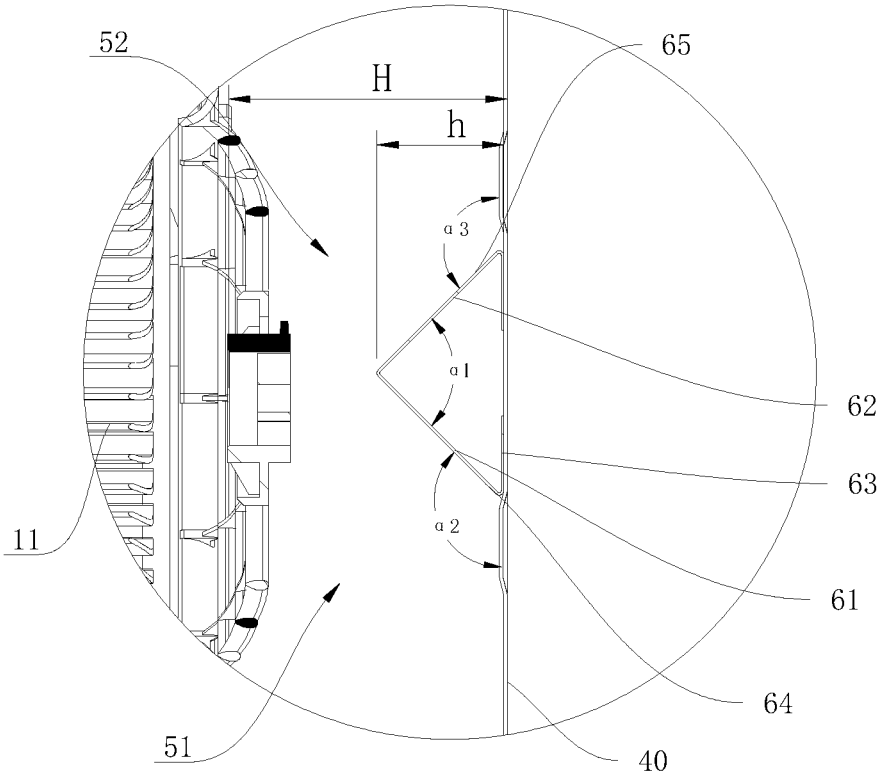
FIG. 7 is a schematic view of the installation position of the spacer at portion R in FIG. 4.

As shown in FIG. 7, FIG. 7 is a schematic view of the installation position of the spacer at portion R in FIG. 4, on the basis of the first and second embodiments, the distance between the inner wall of the case 40 and the air inlet 122 is H, and the distance between the end of the spacer 60 close to the air inlet 122 and the inner wall of the case 40 is h, h is at least 0.2H, and h is not more than 0.8H. The distance h between one end of the spacer 60 close to the air inlet 122 and the end close to the inner wall of the case 40 is the height of the spacer 60, h is smaller than the distance H between the inner wall of the case 40 and the air inlet 122.

When the distance his less than 0.2H, the amount of airflow that can be blocked by the spacer 60 is small, and the area where the spacer 60 can act on the airflow is very small, and the effect of the spacer 60 for isolating the airflow is relatively small. When the distance h is greater than 0.8H, the distance between the end of the spacer 60 away from the case 40 and the air inlet 122 is relatively short, and when the airflow flows along the surface of the spacer 60, a reverse flow is generated before entering the air inlet 122, resulting in turbulence. During installation, the distance h can be half of the distance H between the air inlet 122 and the inner wall of the case 40, that is, h=0.5H.

Figure 8:
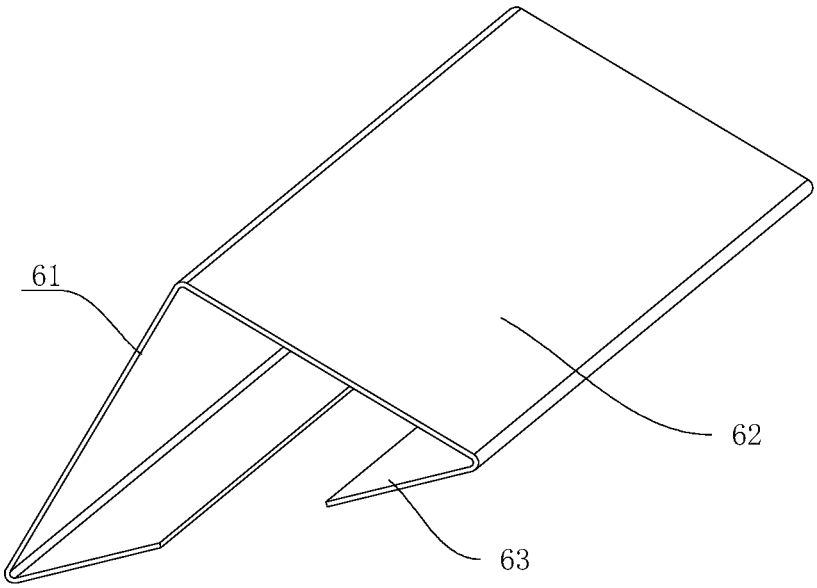
FIG. 8 is a partial structural enlarged view of the spacer.

As shown in FIG. 8, FIG. 8 is a partial structural enlarged view of the spacer. On the basis of the first and second embodiments, the present disclosure provides a possible structure of the spacer 60. The spacer 60 includes a first guide plate 61 and a second guide plate 62. An angle is formed between the first guide plate 61 and the second guide plate 62. The angle between the first guide plate 61 and the second guide plate 62 gradually increases from the air inlet 122 to the inner wall of the case 40. The first guide plate 61 faces the main air inlet area 51 and is used to guide the airflow in the direction of P1 as shown in FIG. 4. The second guide plate 62 faces the auxiliary air inlet area 52 and is used to guide the airflow in the direction of P2 or P3 as shown in FIG. 4, to prevent the airflow in opposite directions from intersecting.

The first guide plate 61 and the second guide plate 62 are inclined, and the airflow flows toward the air inlet 122 along the inclined surface formed by the first guide plate 61 and the second guide plate 62, to prevent the airflow from being turbulent.

The first guide plate 61 and the second guide plate 62 can form a V-shaped structure as shown in FIG. 8, or can form a trapezoidal structure. The first guide plate 61 and the second guide plate 62 are used as two inclined surfaces of the trapezoid structure.

As shown in FIG. 7, further, the angle between the first guide plate 61 and the second guide plate 62 is $\alpha 1$, $\alpha 1$ is at least 60° and not more than 120°. The angle between the first guide plate 61 and the second guide plate 62 is between 60° and 120°, to avoid the problem that the angle between the first guide plate 61 and the second guide plate 62 is too large, which will cause the airflow in the main air inlet area 51 and the auxiliary air inlet area 52 to intersect and cause turbulence, and avoid that when the angle is too small, the problem of reverse flow occurs when the airflow reaches the first guide plate 61 and the second guide plate 62.

In order to facilitate processing, the angle between the first guide plate 61 and the second guide plate 62 can be selected as 90°.

As shown in FIG. 7, further, a first guide surface 64 is formed on the side of the first guide plate 61 away from the inner wall of the case 40, and a second guide surface 65 is formed on the side of the second guide plate 62 away from the case 40. The angle between the second guide surface 65 and the inner wall of the case 40 is $\alpha 3$, the angle between the first guide surface 64 and the inner wall of the case 40 is $\alpha 2$, $\alpha 2$ is not more than $\alpha 3$, and the difference between $\alpha 3$ and $\alpha 2$ does not exceed 30°. The inner wall of the case 40 is taken as a reference, the slope of the first guide surface 64 is greater than the slope of the second guide surface 65. When entering the main air inlet area 51, under the action of the first guide plate 61, the airflow flows to the air inlet 122 of the fan 11. Since the slope of the first guide surface 64 is relatively large, as shown in FIG. 4, the airflow flowing toward the first guide surface 64 in the direction of P1 is rapidly turned under the action of the first guide surface 64, the airflow concentrates to flow toward the middle of the air inlet 122 or along the direction close to the impeller, to improve the air intake efficiency of the fan 11.

Since the slope of the second guide surface 65 is small, the airflow along the direction of P2 or P3 in FIG. 4 flows toward the air inlet 122 of the fan 11 under the action of the second guide surface 65 to achieve a flow guiding effect.

In order to prevent the airflow from sharply turning on the first guide surface 64 or the second guide surface 65, in this embodiment, the first guide surface 64 and/or the second guide surface 65 are arc surfaces, and whether to adopt the arc surface design can be determined according to the airflow volume and the installation positions of the first guide plate 61 and the second guide plate 62.

Figure 9:
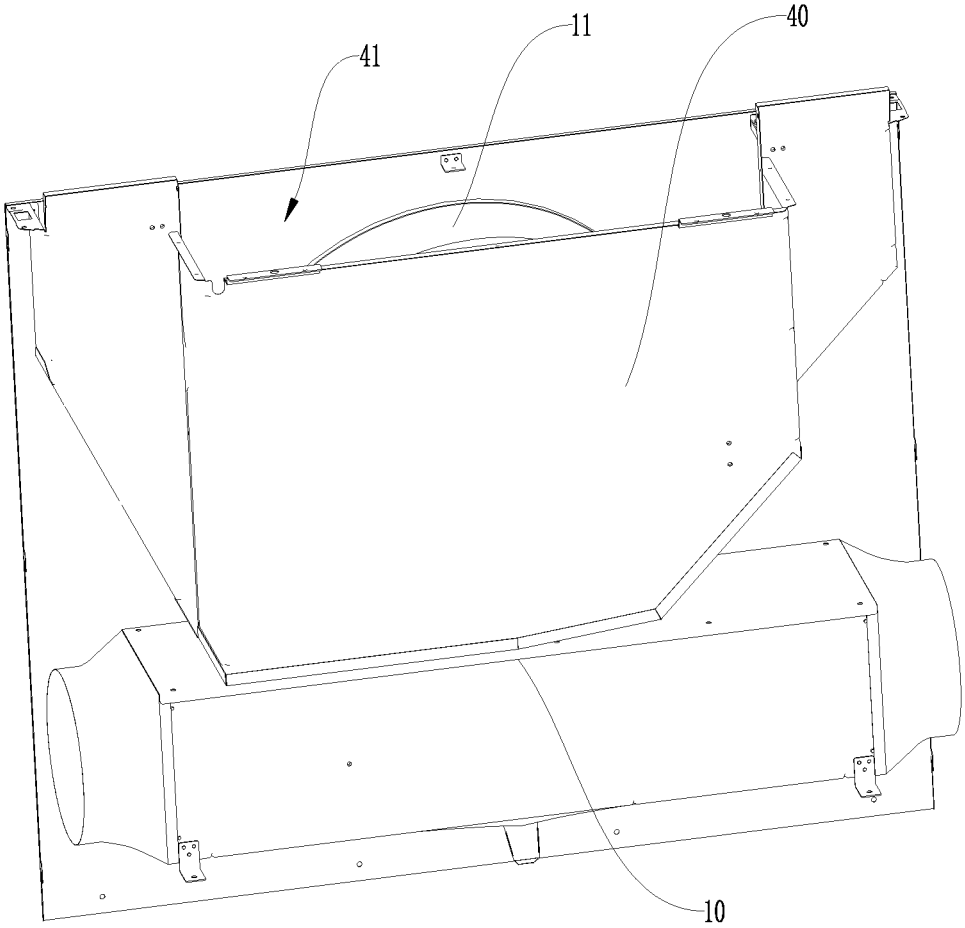
FIG. 9 is a schematic view of an external structure of the range hood according to a sixth embodiment of the present disclosure.

FIG. 9 is a schematic view of an external structure of the range hood according to a sixth embodiment of the present disclosure. The sixth embodiment of the present disclosure provides a range hood, including a case 40, one end of the case 40 being provided with a smoke inlet 41; and a fan 11 provided inside the case 40. An air inlet area 50 is formed between the air inlet 122 of the fan 11 and the side wall of the case 40, a first air passage 55 and a second air passage 56 are formed between the outer walls on both sides of the volute 12 of the fan 11 and the inner wall of the case 40, one end of the first air passage 55 and one end of the second air passage 56 away from the smoke inlet 41 are respectively connected to the part of the air inlet area 50 away from the smoke inlet 41; the air inlet area 50 is provided with a spacer 60, the spacer 60 divides the air inlet area 50 into a first air inlet area 53 on the side of the first air passage 55 and a second air inlet area 54 on the side of the second air passage 56.

Figure 10:
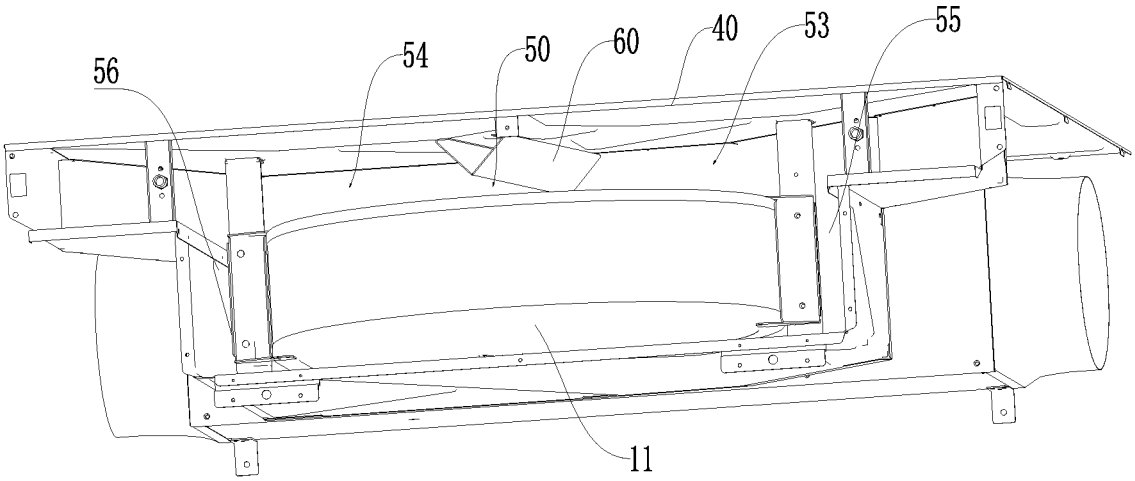
FIG. 10 is an axial side view of the smoke inlet of the range hood in FIG. 9.
Figure 11:
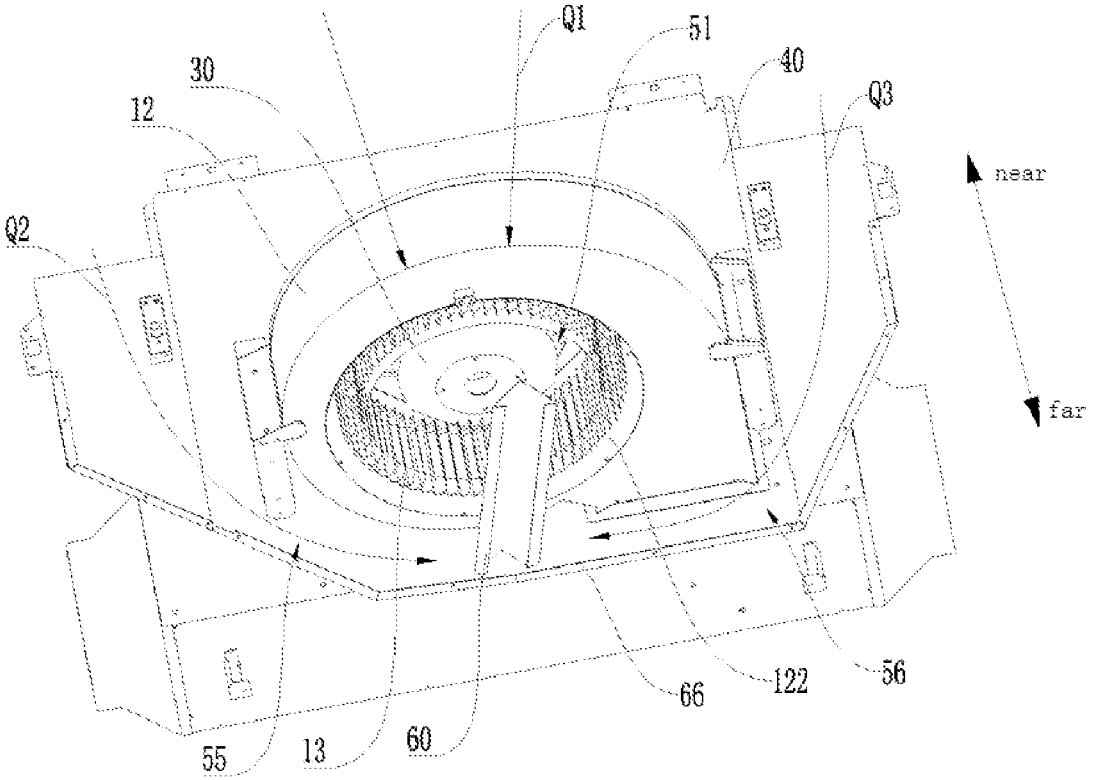
FIG. 11 is an axial side view of the air inlet of the range hood according to the sixth embodiment of the present disclosure in a use state.

FIG. 10 is an axial side view of the smoke inlet of the range hood in FIG. 9, and FIG. 11 is an axial side view of the air inlet of the range hood according to the sixth embodiment of the present disclosure in a use state. The airflow enters the case 40 through the smoke inlet 41, part of the airflow enters the air inlet 122 of the fan 11 along the direction of Q1 as shown in FIG. 11. The first air passage 55 and the second air passage 56 are formed between the outer wall of the volute 12 of the fan 11 and the inner wall of the case 40, part of the airflow enters the first air inlet area 53 from the first air passage 55 along the direction of Q2 as shown in FIG. 11. Part of the airflow enters the second air inlet area 54 from the second air passage 56 along the direction of Q3 as shown in FIG. 11, the spacer 60 is placed on the air inlet area 50 between the first air passage 55 and the second air passage 56. Since the first air passage 55 and the second air passage 56 are located on both sides of the volute 12 of the fan 11, when the airflow flows toward the air inlet 122 of the fan 11 along the surface of the volute 12, the airflows in the first air inlet area 53 and the second air inlet area 54 flow in opposite directions, when reaching the position of the spacer 60, under the action of the spacer 60, the two airflows are guided toward the air inlet 122, to prevent the two airflows from intersecting and causing turbulence.

Since the airflow of the first air inlet area 53 and the second air inlet area 54 will flow toward the air inlet 122 under the action of the spacer 60, the two airflows will not collide. Further, the noise caused by the collision of the airflow can be avoided, which is helpful for reducing the operating noise of the range hood 10 and improving the user's sense of hearing.

When the spacer 60 guides the airflow of the first air inlet area 53 and the second air inlet area 54 into the air inlet 122, since the two airflows can enter the fan 11 through the air inlets 122 corresponding to the first air inlet area 53 and the second air inlet area 54 respectively, the air resistance at the air inlet 122 is reduced, and the problem of increased air resistance at the air inlet 122 due to inconsistent airflow directions will not arise.

When the fan 11 is running, since the air volume of each area of the fan 11 is different, disposing the spacer 60 to separate the air inlet area 50 can block airflow turbulence in different directions and allow each area to enter air separately, to improve the efficiency of the fan 11 for absorbing smoke.

As shown in FIG. 11, in this embodiment, the air inlet 122 is divided into a main air inlet area 51 and an auxiliary air inlet area 52 by a partition surface along a radial direction of the air inlet 122; the main air inlet area 51 is located on a side of the air inlet 122 close to the smoke inlet 41, and the auxiliary air inlet area 52 is located on a side of the air inlet 122 away from the smoke inlet 41; and one end of the case 40 away from the smoke inlet 41 is provided with a bottom plate 66, one end of the spacer 60 away from the smoke inlet 41 is connected to the bottom plate 66, and one end of the spacer 60 away from the bottom plate 66 is extended into the auxiliary air inlet area 52. As shown in FIG. 11, the airflow along the direction of Q1 enters the main air inlet area 51, and the airflow along the directions of Q2 and Q3 enters the auxiliary air inlet area 52.

As shown in FIG. 11, in the side-suction range hood 10, when the fan 11 is running, the intake air volume on the side of the fan 11 close to the smoke inlet 41 is greater than the intake air volume on the side away from the smoke inlet 41. Therefore, in this embodiment, the air inlet 122 close to the smoke inlet 41 is used as the main air inlet area 51.

One end of the spacer 60 away from the bottom plate 66 can extend into the main air inlet area 51 to partially guide airflow along different directions in the main air inlet area 51. The end of the spacer 60 away from the bottom plate 66 may also not extend into the main air inlet area 51. When the spacer 60 does not extend into the main air inlet area 51, one end of the spacer 60 away from the bottom plate 66 is flush with the rotation center of the fan 11, and can also be completely located in the auxiliary air inlet area 52.

When the spacer 60 is located in the auxiliary air inlet area 52, the spacer 60 separates the auxiliary air inlet area 52 to form a first air inlet area 53 and a second air inlet area 54, the airflow of the first air passage 55 enters the auxiliary air inlet area 52 along the direction of Q2 as shown in FIG. 11. The airflow of the second air passage 56 enters the auxiliary air inlet area 52 along the direction of Q3 as shown in FIG. 11. The airflow enters the air inlet 122 from the first air inlet area 53 and the second air inlet area 54 under the blocking of the spacer 60, to realize the airflow input of the auxiliary air inlet area 52.

In this embodiment, the smoke inlet 41 is located above the case 40, and the width of the end of the case 40 away from the smoke inlet 41 gradually decreases, and one end of the case 40 away from the smoke inlet 41 has a V-shaped structure. The main air inlet area 51 is located at the upper area of the air inlet 122 of the fan 11, and the auxiliary air inlet area 52 is located at the lower area of the air inlet 122 of the fan 11.

When the fan 11 is running, the airflow enters the main air inlet area 51 from top to bottom along the direction of Q1 as shown in FIG. 11. After the airflow in the first air passage 55 and the second air passage 56 enters the auxiliary air inlet area 52 along the directions of Q2 and Q3 as shown in FIG. 11, due to the diversion effect of the case 40, and when the airflow is in the auxiliary air inlet area 52, the directions of the airflows input by the first air passage 55 and the second air passage 56 are opposite, the spacer 60 is used to block the intersection of the airflows on both sides, to prevent turbulence at the intersection of the airflows.

By adopting the V-shaped case 40, the turbulence problem existing at the edge of the exemplary common rectangular parallelepiped case 40 can be avoided, and the effect of diversion can be achieved. With the gradually narrowed structure of the case 40, the airflow can flow to the auxiliary air inlet area 52 along the relatively smooth path formed by the inner wall of the case 40, to avoid turbulence on the inner wall surface of the case 40. When the range hood 10 is running, the smoke enters the inside of the case 40 through the smoke inlet 41, and can be concentrated to the bottom of the case 40. Since the widths of the two sides of the case 40 are gradually narrowed, the oil droplets can move toward the bottom of the case 40 in a concentrated manner, which facilitates the collection of the oil droplets.

Figure 12:
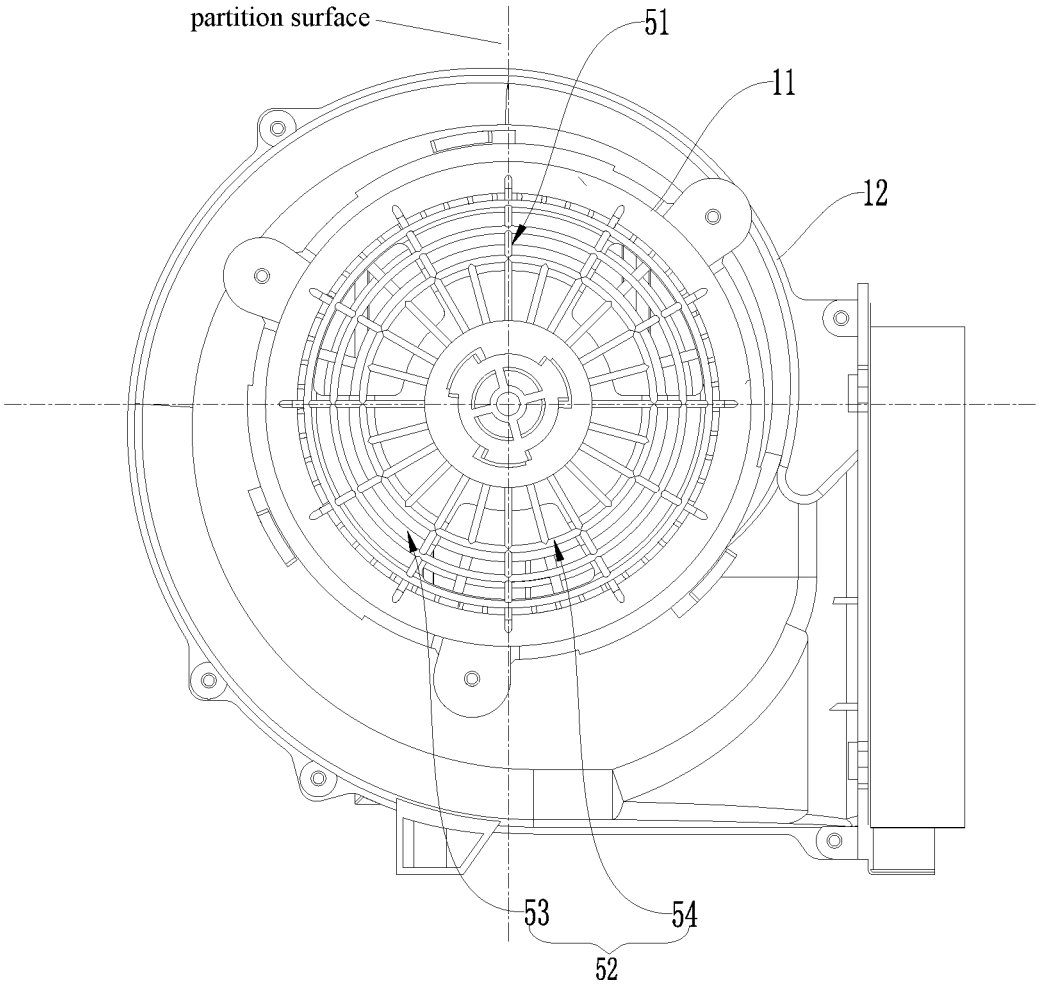
FIG. 12 is a schematic view of the distribution of the air inlet area of the fan according to the sixth embodiment of the present disclosure.

As shown in FIG. 11 and FIG. 12, FIG. 12 is a schematic view of the distribution of the air inlet area of the fan according to a sixth embodiment of the present disclosure. When the fan 11 is running, the air volume of each part of the air inlet 122 is different. In this embodiment, the area of the first air inlet area 53 is larger than the area of the second air inlet area 54, the air intake volume of the first air inlet area 53 is larger than the air volume of the second air inlet area 54. Therefore, the spacer 60 is offset to the second air intake area 54 to increase the effective air intake area of the first air intake area 53.

The structure of the fan 11 in FIG. 11 and FIG. 12 is taken as an example. When the side-suction range hood 10 is running, the two axes in the horizontal direction and the vertical direction are the boundaries, the air intake volume of the third and fourth quadrants of the air intake area 50 will be relatively large. When the airflow flows to the third and fourth quadrants along the first air passage 55 and the second air passage 56, the flow directions thereof will be opposite, and the turbulence will be generated at the intersection of the airflow. Since the rotation direction of the fan 11 is certain, the airflow in the third and fourth quadrants will also be different. The spacer 60 separates the first air inlet area 53 and the second air inlet area 54 into different sizes. When the airflow is input, the effective air intake area on the side of the third quadrant with larger air flow can be relatively larger, to improve the utilization rate of the fan 11.

In the case of different airflow volumes in the third and fourth quadrants, the spacer 60 is used to change the effective air inlet area of the first air inlet area 53 and the second air inlet area 54, and the airflow can have a relatively effective flow space in the corresponding first air inlet area 53 and the second air inlet area 54, to avoid that when a large amount of airflow reaches the spacer 60, the airflow is turbulent on both sides of the spacer 60 due to the excessive airflow, which can effectively reduce the air resistance, and can effectively improve the air intake efficiency of the first air intake area 53 and the second air intake area 54.

In view of the problem of different air intakes in the third and fourth quadrants, in this embodiment, one end of the spacer 60 close to the air inlet 122 is inclined to the second air inlet area 54. When the airflow along the direction of Q2 in FIG. 11 reaches the first air inlet area 53, the airflow can be guided to the direction of the rotation center of the fan 11 through the spacer 60. An inclined airflow guide surface is formed by the spacer 60, and a large amount of airflow can move along a relatively smooth airflow path, to avoid turbulence of the airflow under the blocking of the spacer 60 when the airflow volume is large.

In the second intake area 54, due to the influence of the rotation direction of the fan 11 itself, the airflow in the fourth quadrant in the air inlet area 50 of the fan 11 will be smaller than that in the third quadrant. Therefore, the spacer 60 is inclined toward the second air inlet area 54 to reduce the air inlet area of the second air inlet area 54. At the same time, when the airflow enters the second air inlet area 54 along the direction of Q3 in FIG. 11. Since the airflow volume in the second air inlet area 54 is smaller than that of the first air inlet area 53, the air is concentrated in the direction of the surface of the impeller 13 of the fan 11 under the action of the spacer 60. When the motor drives the impeller 13 to rotate to do work, the airflow concentrates and flows in the direction of the impeller 13, which can improve the utilization rate of the impeller 13 to do work.

Figure 13:
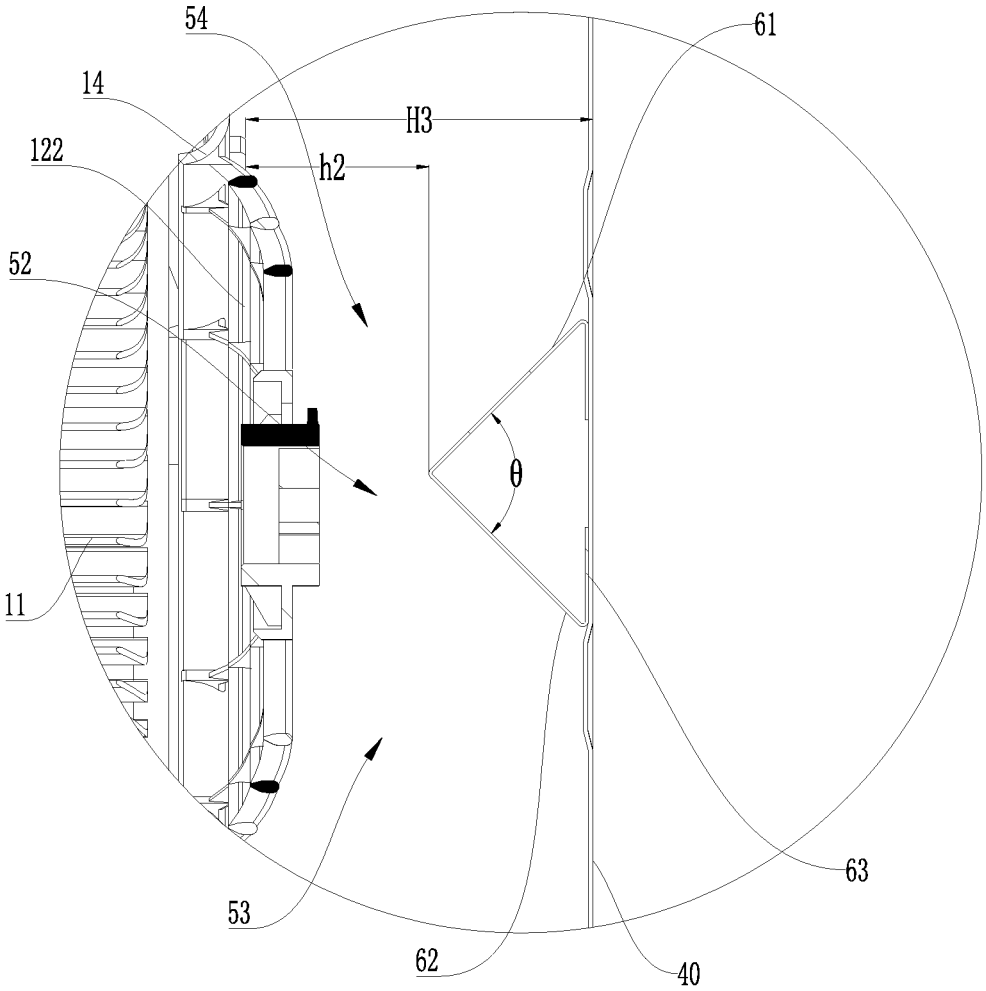
FIG. 13 is a schematic view of a positional relationship between the fan and the spacer according to the sixth embodiment of the present disclosure.

As shown in FIG. 13, FIG. 13 is a schematic view of a positional relationship between the fan and the spacer according to the sixth embodiment of the present disclosure.

In this embodiment, the spacer 60 is provided on the inner wall of the case 40, and there is no gap between the spacer 60 and the inner wall of the case 40. A support portion 63 can be provided on the side of the spacer 60 close to the inner wall of the case 40 to be fixed on the case 40.

When the airflow enters the case 40, the airflow will flow along the inner wall of the case 40. The spacer 60 is installed on the inner wall of the case 40, and the airflow can only flow along the spacer 60 toward the air inlet 122. In this way, turbulence is avoided at the intersection of the airflows of the main air inlet area 51 and the auxiliary air inlet area 52.

As shown in FIG. 13, in this embodiment, the distance between the inner wall of the case 40 and the air inlet 122 is H3, the distance between one end of the spacer 60 close to the air inlet 122 and the inner wall of the case 40 is h2, and h2 is at least 0.4H3 and not more than 0.6H3. The distance h2 between one end of the spacer 60 close to the air inlet 122 and the end close to the inner wall of the case 40 is the height of the spacer 60, h2 is smaller than the distance H3 between the inner wall of the case 40 and the air inlet 122.

When the distance h2 is less than 0.4H3, the amount of airflow that can be blocked by the spacer 60 is small, and the spacer 60 can act on the airflow area is very small, and the effect it can produce to isolate the airflow is relatively small. When the distance h2 is greater than 0.6H3, the distance between the end of the spacer 60 away from the case 40 and the air inlet 122 is relatively short. When the airflow flows along the surface of the spacer 60, it is sharply turned before entering the air inlet 122, causing turbulence. During installation, the distance h2 may be half of the distance H3 between the air inlet 122 and the inner wall of the case 40, that is, h2=0.5H3.

As shown in FIG. 8, on the basis of the sixth embodiment, the present disclosure provides a possible structure of the spacer 60. The spacer 60 includes a first guide plate 61 and a second guide plate 62. An angle is formed between the first guide plate 61 and the second guide plate 62. The angle between the first guide plate 61 and the second guide plate 62 gradually increases from the air inlet 122 to the inner wall of the case 40. The first guide plate 61 faces the first air inlet area 53 and is used to guide the airflow in the direction of Q2 in FIG. 11. The second guide plate faces the second air inlet area 54, and is used to guide the airflow in the direction of Q3 in FIG. 11, to prevent the airflow in opposite directions from intersecting.

The first guide plate 61 and the second guide plate 62 are inclined, and the airflow flows toward the air inlet 122 along the inclined surface formed by the first guide plate 61 and the second guide plate 62, to prevent the airflow from being turbulent.

The first guide plate 61 and the second guide plate 62 can form a V-shaped structure as shown in FIG. 8, or can form a trapezoidal structure. The first guide plate 61 and the second guide plate 62 are used as two inclined surfaces of the trapezoid structure.

As shown in FIG. 13, further, the angle between the first guide plate 61 and the second guide plate 62 is θ, θ is at least 80° and not more than 110°. The angle between the first guide plate 61 and the second guide plate 62 is between 80° and 110°, to avoid the problem that the angle between the first guide plate 61 and the second guide plate 62 is too large, which will cause the airflow in the first air inlet area 53 and the second air inlet area 54 to intersect and cause turbulence, and avoid that when the angle is too small, the problem of reverse flow occurs when the airflow reaches the first guide plate 61 and the second guide plate 62.

In order to facilitate processing, the angle between the first guide plate 61 and the second guide plate 62 can be selected as 90°.

The range hood 10 may further include other structural components, such as a fume collecting hood 70, an air inlet ring, an air guide ring 14, etc., which can be referred to as exemplary technologies and will not be repeated here.

The present disclosure proposes a seventh embodiment on the basis of the above-mentioned sixth embodiment. In the seventh embodiment, an integrated stove is disclosed.

Figure 14:
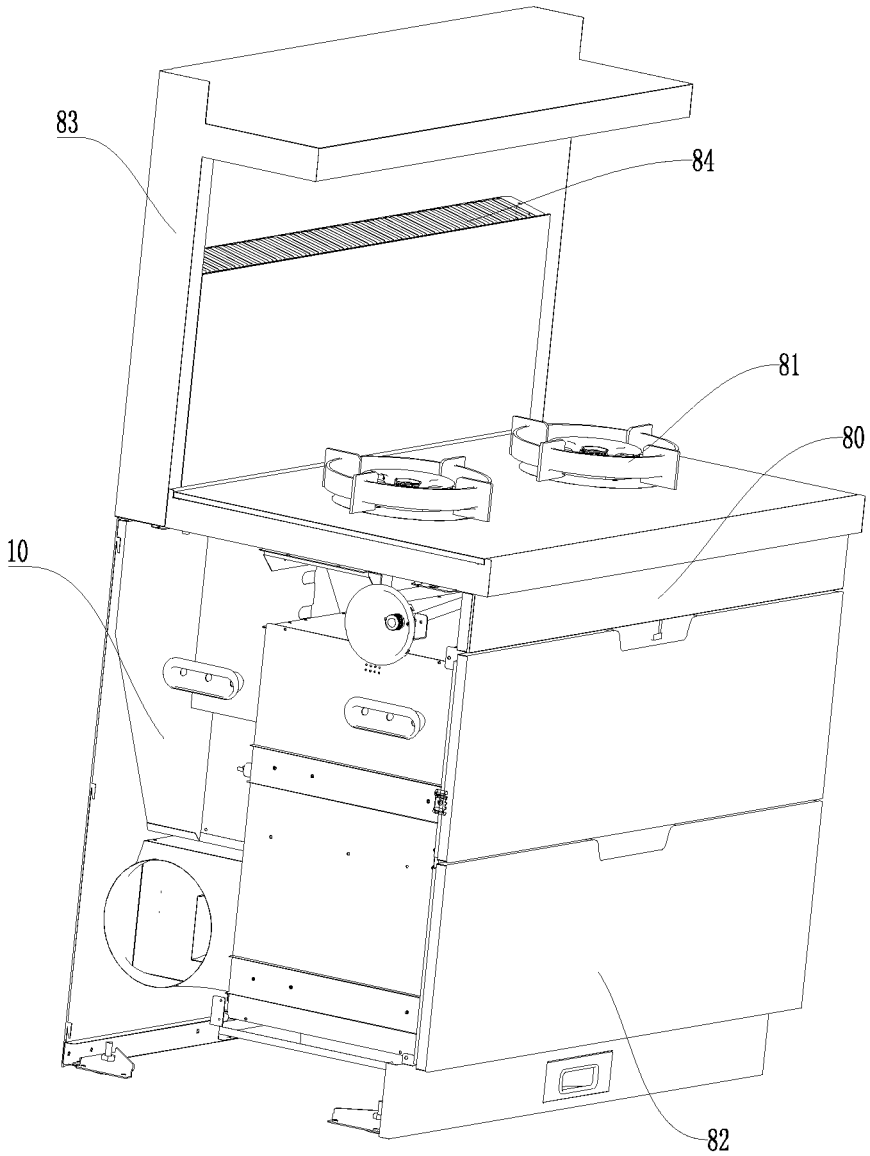
FIG. 14 is a schematic structural view of the integrated stove according to a seventh embodiment of the present disclosure.
Figure 15:
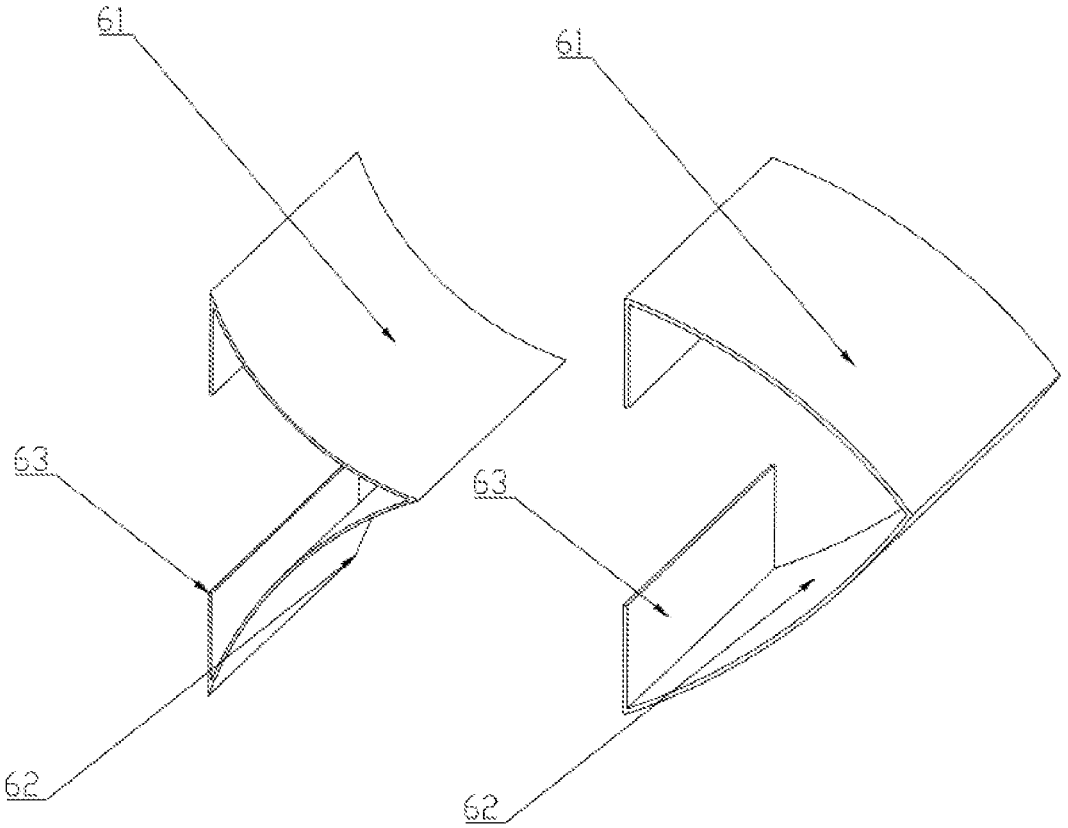

As shown in FIG. 14, FIG. 14 is a schematic structural view of the integrated stove according to a seventh embodiment of the present disclosure. The integrated stove 80 is provided with the range hood 10 described in the sixth embodiment above. The range hood 10 is installed on one side of the integrated range hood 80 as the range hood 11 system of the integrated range hood 80. The range hood 10 is also provided with a range hood system 81 and an additional assembly 82. In order to save space, the smoke inlet 41 is arranged above the case 40, and the handpiece 83 is arranged on the integrated stove 80, a handpiece inlet 84 is provided on the handpiece 83, and the handpiece inlet 84 is in communication with the smoke inlet 41, to realize the input of smoke.

By adopting the above structure, when the integrated stove 80 is running, the smoke enters the smoke inlet 41 along the inlet 84 of the handpiece, and after entering the inside of the cabinet 40, since the spacer 60 can block the intersection of the airflows entering the first air passage 55 and the second air passage 56, the airflow intersection can be prevented from generating turbulence, to help to improve the efficiency of the fan 11 for absorbing the smoke. Since airflows in different directions do not collide, the noise generated by the range hood 10 during operation can be reduced, to improve the user's sense of hearing and enhancing the user experience. The integrated cooktop 80 may further include other functional components, and reference may be made to exemplary technologies, which will not be repeated here.

What is claimed is:

1. A range hood, comprising:

a case provided with a smoke inlet; and a fan provided inside the case; wherein an air inlet area is formed between an air inlet of the fan and a side wall of the case, the air inlet area being provided with a spacer configured to divide the air inlet area into at least two air inlet sub-areas the spacer being provided on an inner wall of the case;

a distance between one end of the spacer close to the air inlet and the inner wall of the case is not more than 0.8 times of a distance between the inner wall of the case and the air inlet.

2. The range hood of claim 1, wherein:

the spacer is configured to divide the air inlet area into a main air inlet area of the at least two air inlet sub-areas close to the smoke inlet and an auxiliary air inlet area of the at least two air inlet sub-areas away from the smoke inlet, the main air inlet area being in communication with the smoke inlet; and a first air passage is formed between an outer wall of a volute of the fan and an inner wall of the case, and the auxiliary air inlet area is in communication with the smoke inlet through the first air passage.

3. The range hood of claim 2, wherein:

a second air passage is formed between the outer wall of the volute of the fan and the inner wall of the case; and the first air passage and the second air passage are respectively provided on two sides of the fan, and one end of the second air passage away from the smoke inlet is in communication with the auxiliary air inlet area.

4. The range hood of claim 2, wherein an area of the main air inlet area is equal to that of the auxiliary air inlet area.

5. The range hood of claim 1, wherein:

a distance that the spacer is offset from a rotation center of the fan toward the smoke inlet is not more than 0.2 times a diameter of the air inlet of the fan; or a distance that the spacer is offset from the rotation center of the fan toward a direction away from the smoke inlet is not more than 0.1 times the diameter of the air inlet of the fan.

6. The range hood of claim 1, wherein:

the air inlet area is provided with two spacers;

a distance between one of the two spacers that is close to the smoke inlet and a rotation center of the fan is not more than 0.2 times a diameter of the air inlet of the fan; and/or a distance between the other of the two spacers that is away from the smoke inlet and the rotation center of the fan is not more than 0.1 times the diameter of the air inlet of the fan.

7. The range hood of claim 2, wherein:

the air inlet area is provided with two spacers, the two spacers are respectively provided in the main air inlet area and the auxiliary air inlet area;

a distance between one of the two spacers that is in the main air inlet area and a rotation center of the fan is not more than 0.2 times the diameter of the air inlet of the fan; and a distance between the other of the two spacers that is in the auxiliary air inlet area and the rotation center of the fan is not more than 0.1 times the diameter of the air inlet of the fan.

8. The range hood of claim 1, wherein the spacer comprises a first sub-spacer and a second sub-spacer, with a first angle therebetween.

9. The range hood of claim 8, wherein the first angle between the first sub-spacer and the second sub-spacer is at least 60° and no more than 120°.

10. The range hood of claim 8, wherein:

a first guide surface is formed at a side of a first guide plate away from the inner wall of the case, and a second guide surface is formed at a side of a second guide plate away from the case;

a second angle between the first guide surface and the inner wall of the case is not more than a third angle between the second guide surface and the inner wall of the case; and a difference between the third angle and the second angle is not more than 30°.

11. The range hood of claim 10, wherein the first guide surface and/or the second guide surface are arc surfaces.

12. The range hood of claim 1, wherein the smoke inlet is located at the lower part of the case.

13. The range hood of claim 1, wherein:

a first air passage and a second air passage are formed between outer walls of a volute of the fan on both sides of the fan respectively and the inner wall of the case;

one end of the first air passage and one end of the second air passage away from the smoke inlet are respectively in communication with the air inlet area away from the smoke inlet; and the spacer is configured to divide the air inlet area into a first air inlet area of the at least two air inlet sub-areas on a side close to the first air passage and a second air inlet area of the at least two air inlet sub-areas on a side close to the second air passage.

14. The range hood of claim 13, wherein:

the air inlet is divided, by a partition surface along a radial direction of the air inlet, into a main air inlet area and an auxiliary air inlet area;

the main air inlet area is located on a side of the air inlet close to the smoke inlet, and the auxiliary air inlet area is located on a side of the air inlet away from the smoke inlet; and one end of the case away from the smoke inlet is provided with a bottom plate, one end of the spacer away from the smoke inlet is connected to the bottom plate, and another end of the spacer away from the bottom plate extends into the auxiliary air inlet area.

15. The range hood of claim 14, wherein:

another end of the spacer away from the bottom plate is flush with a rotation center of the fan; or another end of the spacer away from the bottom plate is located in the auxiliary air inlet area.

16. The range hood of claim 13, wherein an area of the first air inlet area is larger than that of the second air inlet area.

17. The range hood of claim 13, wherein the smoke inlet is located above the case, and a width of one end of the case away from the smoke inlet gradually decreases, so that the one end of the case away from the smoke inlet has a V-shaped structure.

18. An integrated stove, comprising:

a range hood, comprising:

a case provided with a smoke inlet; and a fan provided inside the case; wherein an air inlet area is formed between an air inlet of the fan and a side wall of the case, the air inlet area being provided with a spacer, and the spacer is configured to divide the air inlet area into at least two air inlet sub-areas;

a first air passage and a second air passage are formed between outer walls of a volute of the fan on both sides of the fan and the inner wall of the case;

one end of the first air passage and one end of the second air passage away from the smoke inlet are respectively in communication with the air inlet area away from the smoke inlet;

the spacer is configured to divide the air inlet area into a first air inlet area of the at least two air inlet sub-areas on a side close to the first air passage and a second air inlet area of the at least two air inlet sub-areas on a side close to the second air passage, the spacer being provided on an inner wall of the case; and a distance between one end of the spacer close to the air inlet and the inner wall of the case is not more than 0.8 times of a distance between the inner wall of the case and the air inlet.

* * * * *